United States Patent [19]

Giles et al.

[11] Patent Number: 4,882,887

[45] Date of Patent: Nov. 28, 1989

[54] MOBILE HOME ANCHOR

[75] Inventors: Charles E. Giles, Grand Terrace; Richard J. Clifton, Ontario, both of Calif.

[73] Assignee: C & R Pier Manufacturing, Riverside, Calif.

[21] Appl. No.: 213,908

[22] Filed: Jun. 30, 1988

[51] Int. Cl.[4] ..... E02D 27/48

[52] U.S. Cl. ..... 52/126.6; 52/126.7; 52/143; 52/DIG. 11; 254/DIG. 4; 254/100; 248/228

[58] Field of Search ..... 52/126.6, 126.7, 23, 52/169.9, 299, DIG. 11, 143; 248/352, 228, DIG. 4, 100

[56] References Cited

U.S. PATENT DOCUMENTS

| | | | |
|---|---|---|---|
| 1,976,595 | 11/1934 | Asleson et al. | 248/228 |
| 2,625,369 | 1/1953 | Lichty et al. . | |
| 3,232,584 | 2/1966 | Miles | 248/352 |
| 3,303,231 | 9/1971 | Kilborn et al. . | |
| 3,655,161 | 4/1972 | Schueler | 254/100 |
| 3,667,711 | 6/1972 | Kissel | 248/228 X |
| 3,713,259 | 1/1973 | Tkach . | |
| 3,828,491 | 8/1974 | Koon et al. . | |
| 3,830,024 | 8/1974 | Warnke . | |
| 3,879,905 | 4/1975 | Catalano, Sr. . | |
| 4,404,780 | 9/1983 | Josephson . | |
| 4,541,155 | 9/1985 | Gagnon | 248/228 X |
| 4,546,581 | 10/1985 | Gustafson | 52/169.9 |
| 4,558,544 | 12/1985 | Albrecht et al. | 52/126.6 |

FOREIGN PATENT DOCUMENTS

| | | | |
|---|---|---|---|
| 1025815 | 3/1958 | Fed. Rep. of Germany | 248/228 |

*Primary Examiner*—David A. Scherbel
*Assistant Examiner*—Lan Mai
*Attorney, Agent, or Firm*—Sheldon & Mak

[57] ABSTRACT

A mobile home anchor apparatus that withstands high wind loading and other forces in any direction includes a pylon-mounted support member for supporting a frame flange of a mobile building structure. The support member has a bladed clamped member that permanently deforms a flange portion of the frame when it it tightened against the support member, and a stop member that receives an opposite side portion of the flange. The clamp member is mountable in selected locations on the support member for accommodating variant flange widths of the frame, blade members of the clamp member extending in sloped relation to the support member across an edge of the first flange portion.

21 Claims, 1 Drawing Sheet

MOBILE HOME ANCHOR

BACKGROUND

The present invention relates to structural supports and more particularly to a supporting anchor for a mobile building structure.

Mobile building structures such as mobile homes are commonly utilized to provide living facilities which can be moved from place to place. Conventional construction provides a housing or body having a floor that is rigidly attached to a frame structure that usually includes flanged frame members such as I-beams. Typically, the frame structure is supported at a designed location on a plurality of stands or pylons that support the frame members. In order to provide stability in storms and other disturbances, various schemes have been utilized for anchoring the pylons to the ground, and for attachment to the frame member. However, the mobile building anchors or the prior art generally exhibit one or more of the following disadvantages:

1. They require holes to be drilled in the frame structure for receiving connecting fasteners, undesirably adding to the cost of installation, and undesirably weakening the structure.

2. They are ineffective for resisting the large forces having any directional orientation as required by resent and expected legislation. This is because existing clamping devices for connecting pylons to the frame members have limited resistance to longitudinal movement of the frame members.

3. They are unsuitable for use with frame structures having a variety of flange widths. Generally, were there are provisions for variant flange widths, the attachment to the frame member is ineffective for resisting relative movement in both the longitudinal and lateral directions relative to the frame members.

Thus there is a need for a mobile home anchor that is effective in withstanding forces having any directional orientation, that accommodates a variety of frame structure configurations and sizes, which is inexpensive and easy to install.

SUMMARY

The present invention is directed to a mobile home anchor apparatus and method that meets this need. The apparatus includes a support member for contacting a flanged frame member of a mobile building structure, means for anchoring the support member, a bladed clamp member, and fastener means for securing the clamp member to the support member, the blade member being adapted for locally deforming a flange member of the frame along a line intersecting a side edge of the flange member in response to tightening of the fastener means for preventing relative movement between the frame member and the support member. Preferably the apparatus includes stop means on the support member for preventing movement of the frame member in a first direction perpendicular to flange side edge relative to the support member and the clamp member together with the fastener means is adapted for preventing relative movement in a opposite direction relative to the support member. The blade member can be oriented perpendicular to the side edge.

The flange member of the frame member can include first and second flange portions extending on opposite sides of a web member, the blade member contacting the first blade portion, the stop means preferably being adapted for receiving the second flange portion and holding it against the supporting surface of the support member. The stop means can include a stop member extending upwardly from the supporting surface and forming an acute angle therewith for receiving the second flange portion.

Preferably the blade member is heat treated to an elevated hardness for penetrating into structural steel. Preferably the clamp member comprises two of the blade members for enhanced resistance to relative movement of the frame member. The blade members can be formed at opposite ends of the clamp member, the blade members preferably overhanging the supporting surface of the support member for permitting the clamp member to be tightened against the supporting surface in the absence of the frame member without the blade member contacting the support member, there by facilitating handling and storage of the apparatus with out damage to the blade members.

Preferably apex bisectors of the blade members are inclined relative to the supporting surface, intersecting above the supporting surface for enhanced resistance to relative movement between the frame member and the support member. More preferably, respective outside blade surfaces are inclined outwardly and downwardly to respective blade apexes for promoting further penetration by at least one of the blade members in response to an applied force in a direction parallel to the first side edge.

A bisector of an included angle between the blade members in the plane of the supporting surface is preferably perpendicular to the first edge of the flange member for equal resistance to applied forces in opposite directions along the first edge.

When the apparatus is to be used with frame members having variant flange widths, the invention includes means for selectively locating the clamp member in a plurality of discrete positions relative to the support member. The discrete positions for the clamp member advantageously enhance the resistance of the apparatus to forces perpendicular to the first edge of the flange member. Preferably the fastener means includes a pair of spaced apart fastener members that protrude the support member and the clamp members, the means for locating including a pair of first engagement means on one of the clamp member and the support member and a plurality of pairs of second engagement means on the other member, the fastener members engaging the first engagement means and a selected pair of the second engaging means corresponding to the selected discrete position of the clamp member. The second engaging means can include three pair of clearance holes in the support member The means for securing the support member can include a threaded member extending rigidly from the support member. Also, a pylon having an anchorable base and a tubular collar rigidly spaced above the base and inclosing a portion of the threaded member to effect a rigid adjustable connection of the support member to the pylon structure.

The present invention also includes a method for anchoring a mobile building structure having a body member rigidly supported on a frame member, the frame member having a flange member extending therefrom and spaced from the body member, the flange member having a first side edge, the method comprising the steps of:

(a) providing a support member having a supporting surface;

(b) anchoring the support member with the supporting surface in contact with the flange member;

(c) providing a clamp member having a blade member; and (d) tightly fastening the clamp member to the support member with the flange member between the blade member and the supporting surface, whereby the blade member penetrates into the flange member along a line intersecting the first side edge for preventing relative movement between the frame member and the support member.

DRAWINGS

These and other features, aspects, and advantages of the present invention will become better understood with reference to the following description, appended claims, and accompanying drawings where:

DESCRIPTION

Figures 1, 2, 3, 4:
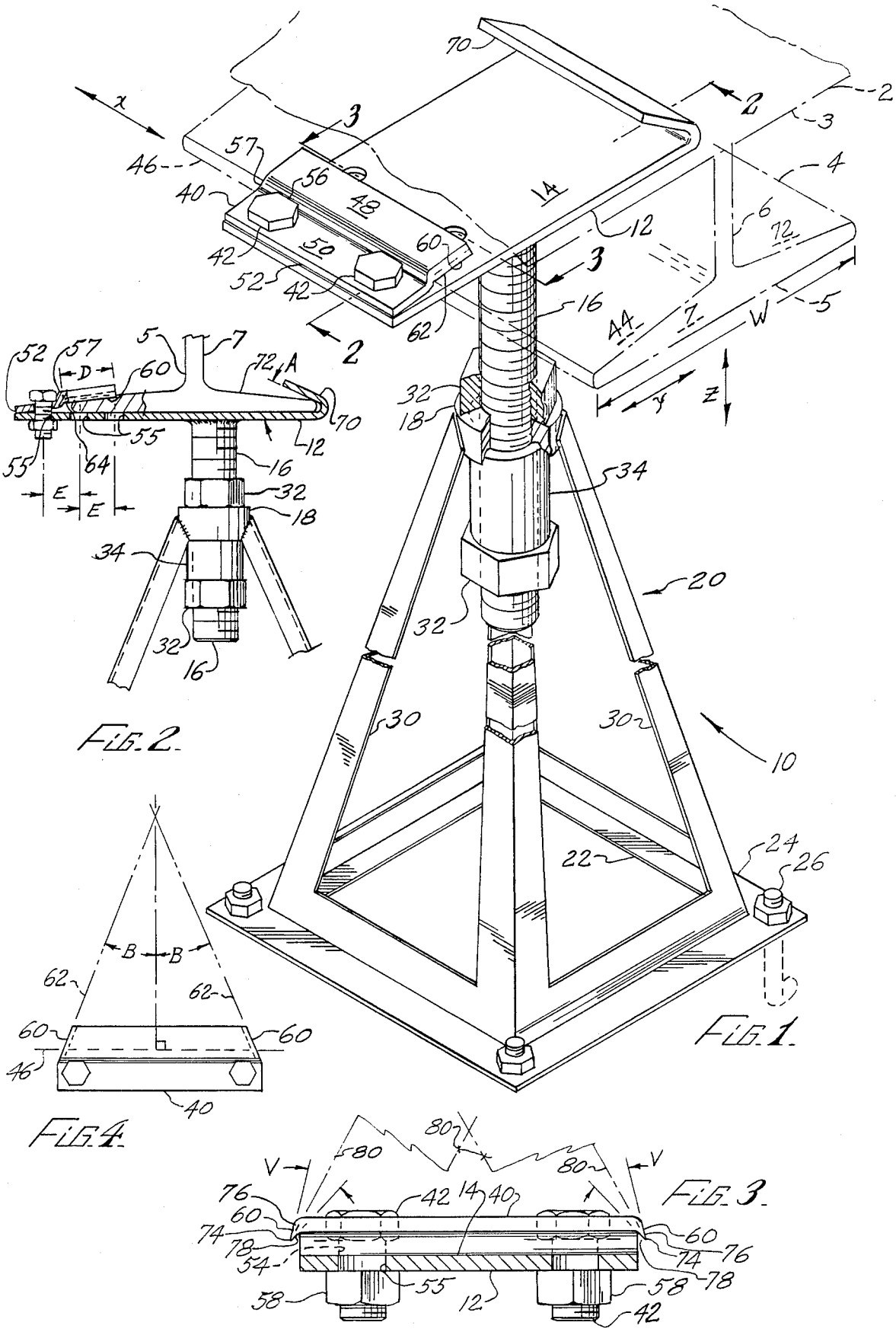
FIG. 1 is a fragmentary sectional elevational perspective view of apparatus according to the present invention in use supporting a mobile building.
FIG. 2 is a fragmentary sectional elevational view of the of FIG. 1 on line 2—2 of FIG. 1.
FIG. 3 is a fragmentary sectional elevational view of the FIG. 1 on line 3—3 of FIG. 1.
FIG. 4 is a fragmentary plan view of the apparatus of FIG. 1 line 4—4 of FIG. 2.

The present invention is directed to an anchor apparatus for mobile building structures that is intended to withstand forces in any direction. With reference to the drawings, and FIGS. 1–3 in particular, a building structure 2 has a housing or body 3 and a rigidly attached floor-supporting frame 4 that includes a spaced plurality of longitudinal frame members 5. Each frame member 5 includes a vertically extending web member 6 and a horizontally extending flange member 7 in spaced relation to the body 3. According to the present invention, an anchor apparatus 10 includes a support member 12 having a supporting surface 14 for contacting and supporting the frame member 5 of the structure 2. A threaded post member 16 is rigidly connected to the support member 12, extending downwardly and protruding a tubular collar 18 of an anchoring pylon 20. The pylon 20 has a polygonal base 22 including a perforate mounting member 24 for receiving an anchor member 26 that can be driven into the ground or otherwise connected to a concrete or timber foundation in a conventional manner. A plurality of legs 30 rigidly connect corners of the base 22 to the tubular collar 18. A pair of lock nuts 32 on the post member 16 effect a rigid and adjustable connection to the pylon 20, a tubular spacer 34 being selectively positioned above or below the collar 18 for extending the range of vertical adjustment of the support member 12.

A clamp member 40 is connected to the support member 12 by a pair of threaded fasteners 42 for clamping a first flange portion 44 of the flange member 7, the first flange portion 44 extending from the web member 6 to a first side edge 46 of the flange member 7. The clamp member 40 forms a Z-shaped cross section, a head portion 48 thereof extending over the first flange portion 44 and a foot portion 50 extending from proximate the first side edge to a line of contact 52 with the support member 12. The fasteners 42 protrude the support member 12 and the foot portion 50 of the clamp member 40. As shown in FIG. 3, the fasteners 42 are configured as hex head cap screws extending downwardly through a pair of clearance holes 54 in the clamp member 40 and another pair of clearance holes 55 in the support member 12, engaging respective nuts 58 below the support member 12. As best shown in FIG. 2, there are three pairs of the clearance holes 55 in the support member 12 for selectively locating the clamp member 40 as further described below. Also, and as best shown in FIG. 1, the fasteners 42 are locked from rotation by engagement of a head flat 56 of the fastener 42 with a web portion 57 of the clamp member 40. The web portion 57 is configured to provide a vertical offset between the head portion 48 and the foot portion 50 of the clamp member 40, the offset being less than a flange thickness of the frame member 5.

An important feature of the present invention is a pair of blade members 60 that are formed in the head portion 48 at opposite ends of the clamp member 40, the blade members 60 being adapted for locally deforming the flange member 7 along lines 62 that intersect the first side edge 46 of the flange member 7. The blade members 60 are hardened by local heat treatment of the clamp member 40 to an elevated hardness for facilitating penetration of the blade members 60 into structural steel forming the frame member 5, as the fasteners 42 are tightened. The local deformation along the lines 62 advantageously prevents relative movement between the frame member 5 and the support member 12 in opposite directions parallel to the first side edge 46, designated direction x in the drawings.

Regarding other possible directions of relative movement, the support member 12 itself prevents relative movement of the frame member 5 in a direction toward the supporting surface 14. The clamp member 40, being tightly connected to the support member 12 by the fasteners 42, prevents movement of the frame member 5 in a z direction away from the supporting surface 14. Also, the clamp member 40, and the blade members 60 in particular, being inclined relative to the supporting surface, form a wedge-shaped slot 64 that prevents movement of the frame member 5 in a y direction toward the fasteners 42. The effectiveness of this combination is enhanced by the inclination of the blade members 60 and the extension of the blade members 60 from the first flange portion 44 beyond the first side edge 46. Thus the deepest penetration of the blade members 60 is at the first edge 46, the penetration becoming shallower toward the blade web member 6 along the lines of contact 62. Moreover, any such movement of the frame member 5 in the y direction would produce an even deeper penetration by the blade members 60.

A stop member 70 is formed in the support member 12 at a location opposite the web member 6 from the fasteners 42, the stop member 70 receiving a second flange portion 72 of the flange member 7. As further shown in FIG. 2, the stop member 70 is curved upwardly from the supporting surface 14, extending upwardly and toward the web member 6 at an acute angle A from the supporting surface for holding the second flange portion 72 as well as for preventing relative movement of the frame member 5 on the support member 12 in the y direction away from the fastener 42.

Preferably each of the blade members 60 is oriented for producing its line of contact 62 with the first flange portion 44 in a direction perpendicular to the first side edge for enhanced resistance to relative movement in the x direction. Alternatively, the blade member 60 can be oriented at an angle B from a perpendicular to the first side edge 46 as shown in FIG. 4. Preferably the angle B is the same for each blade member 60 such that a bisector of the lines of contact 62 is perpendicular to the first side edge 46. Thus the apparatus 10 provides symmetrical resistance to relative movement in the opposite x directions with the blade member 60 having a symmetrical preferred cross-sectional configuration described below.

With particular reference to FIG. 3, the blade members 60 preferably each extend in the x direction to an apex 74 that is located outwardly from a corresponding portion of the supporting surface 14 for preventing contact with the support member 12 during handling of the apparatus 10 prior to its installation. Also, the apex 74 of each blade member 60 is formed at the intersection of an outside blade surface 76 and an inside blade surface 78, the apex 74 having an angle V, bisectors 80 of the angles V intersecting above the supporting surface 14, sloping downwardly and outwardly for producing increased compressive loading in one of the blade member 60 in response to an applied force of the frame member 5 in the x direction relative to the apparatus 10. The increased compressive loading of the blade member 60 advantageously improves the engagement of the blade member 60 with the permanently deformed material of the first flange portion 44 along the line contact 62, and enhances the resistance of the blade member 60 to permanent deformation or fracture in bending. More preferably, the outside blade surfaces 76 also slope downwardly and outwardly toward the respective apexes 74 for urging the blade member 60 to bite further into the first flange portion 44 in response to loading of the frame member 5 in the X direction relative to the support member 12. As also shown in FIG. 3, the fasteners 42 are spaced apart, being located proximate opposite ends of the clamp member 40. Thus the fasteners 42 are effective in preventing rotation of the clamp member 40 relative to the support 12 in the plane of the supporting surface 14. This further enhances the resistance of the apparatus 10 to forces in the x direction.

The blade embers 60 of the clamp member 40 are preferably roughly shaped by a stamping or shearing operation that forms the inside blade surfaces 78. Then, the sloping outside blade surfaces 76 are preferably formed by grinding.

As best shown in FIG. 2, the pairs of clearance holes 55 in the support member 12 provide three discrete positions for the clamp member 40 relative to the support member 12 for use of the apparatus 10 with flange members 5 having a variety of widths W of the flange member 7. For this purpose, the blade members 60 extend a distance D across a full width of the head portion 48 of the clamp member 40. Also, the pairs of clearance holes 55 are spaced in the y direction by a distance E, the distance E being less than the distance D.

The combination of the bladed clamp member 40, the fasteners 42, and the support member 12 of the present invention provides a high degree of resistance to loading, especially in the x direction, but without requiring drilling or other machining of the frame member 5, which would be undesirable for the reasons described above. The apparatus 10 also provides an effective restraint against loading in the other directions, even for frame member 5 of the differing cross-sectional configurations, because of the advantageous combination of the stop member 70, the sloping members 60 that permanently deform the first flange portion 44 of the frame member 5 along the lines of contact 62 intersecting the first side edge 46, and the spaced apart fasteners 42 that selectively engage pairs of the clearance holes 55 in the support member 12.

Although the present invention has been described in considerable detail with reference to certain preferred versions thereof, other versions are possible. Therefore, the spirit and scope of the appended claims should not necessarily be limited to the description of the preferred versions contained herein.

What is claimed is:

1. An anchor apparatus for a mobile building structure having a body member rigidly supported on a frame member, the frame member having a flange member extending therefrom and spaced from the body member, the flange member having a first side edge, the apparatus comprising:

(a) a support member having a supporting surface for contacting the frame member;

(b) means for fixedly securing the support member to a grounded footing;

(c) a clamp member having at least one blade member; and (d) fastener means for connecting the clamp member to the support member, the blade member being adapted for locally deforming the flange member along a line intersecting the first side edge in response to tightening of the fastener means for preventing relative movement between the frame member and the support member in a direction parallel to the first side edge.

2. The apparatus of claim 1 further comprising stop means on the support member for preventing movement of the frame member relative to the support member in a first direction perpendicular to the first side edge, the combination of the clamp member and the fastener means being adapted for preventing movement of the frame member in a second direction relative to the support member, the second direction being opposite the first direction.

3. The apparatus of claim 2 wherein the line of local deformation produced by the blade member is oriented perpendicular to the first side edge.

4. The apparatus of claim 2 wherein the frame member includes a web member, the flange member extending on opposite sides of the web member and including respective first and second flange portions, wherein the blade member contacts the first flange portion, the stop means being adapted for receiving the second flange portion and holding the second flange portion against the supporting surface of the support member.

5. The apparatus of claim 4 wherein the stop means further comprises a stop member, the stop member extending upwardly from the supporting surface of the support member and forming an acute angle therewith for receiving the second flange portion.

6. The apparatus of claim 1 wherein the blade member is heat treated to an elevated hardness for penetrating into structural steel.

7. The apparatus of claim 1 the clamp member comprises two of the blade members.

8. The apparatus of claim 7 wherein the blade members are at opposite ends of the clamp member.

9. The apparatus of claim 8 wherein the supporting surface of the member extends a first distance in a direction parallel to edge of the flange member and the blade members are spaced apart by a second distance, the second distance being slightly greater than the first distance, whereby, when the fastener means is tightened without the flange member being between the clamp member and the supporting surface, the clamp member can contact the supporting surface without the blade members contacting the support member.

10. The apparatus of claim 8 wherein each of the blade members forms an apex included angle in a plane perpendicular to the supporting surface, each of the apex included angles having a bisector, the bisectors being inclined in a plane perpendicular to the supporting surface and parallel to the first side edge, the bisectors intersecting above the supporting surface for facilitating the prevention of relative movement between the frame member and the support member.

11. The apparatus of claim 10 wherein each of the blade members has an outside blade surface on a side thereof opposite the other blade member, the outside blade surfaces being inclined outwardly and downwardly to respective blade apexes for urging further penetration by at least one of the blade members into the flange member in response to an applied force between the frame member and the apparatus in a direction parallel to the first side edge.

12. The apparatus of claim 7 wherein the supporting surface defines a plane of contact with the flange member, the blade members forming an included angle in the plane of contact, a bisector of the included angle being oriented perpendicular to the first edge of the flange member.

13. The apparatus of claim 1 wherein the means for securing the clamp member comprises means for selectively locating the clamp member in a plurality of discrete positions relative to the support member.

14. The apparatus of claim 13 wherein the fastener means comprises a pair of fastener members, the fastener members protruding the support member and the clamp member, and the means for locating comprises a pair of first engagement means on one of the clamp member and the support member and a plurality of pairs of second engagement means on the other of the clamp member and the support member, the fastener members engaging the first engagement means and selectively engaging one pair of the second engaging means.

15. The apparatus of claim 14 wherein the second engaging means comprises three pairs of clearance holes formed in the support member for locating the clamp member in corresponding selected positions relative to the stop means.

16. The apparatus of claim 1 wherein the means for securing comprises a threaded member extending rigidly from the support member.

17. The apparatus of claim 16 wherein the means for securing further comprises a pylon structure having a base, means for anchoring the base, and a tubular collar rigidly supported in spaced relation to the base, the tubular collar enclosing a portion of the threaded member for adjustably rigidly connecting the support member to the pylon structure.

18. An anchor apparatus for a mobile building structure having a body member rigidly supported on a frame member, the frame member having web member and a flange member extending therefrom, spaced from the body member and including first and second flange portions extending on opposite sides of the web member, the first and second flange portions having respective first and second side edges, the apparatus comprising:

(a) a support member having a supporting surface for contacting the frame member;

(b) means for anchoring the support member;

(c) stop means on the support member for preventing movement of the frame member relative to the support member in a first direction perpendicular to the first side edge, the stop means being adapted for receiving the second flange portion and holding the second flange portion against the supporting surface of the support member;

(d) a clamp member having opposite ends;

(e) fastener means for securing the clamp member to the support member; and (f) each end of the clamp member forming a blade member, each blade member being adapted for locally deforming the first flange portion of the flange member along a line intersecting the first side edge in response to tightening of the fastener means for preventing relative movement between the frame member and the support member in a direction parallel to the first side edge, the blade member being heat treated to an elevated hardness for penetrating into the frame member and having respective outside blade surfaces, the outside blade surfaces being inclined outwardly and downwardly to respective blade apexes for urging further penetration by at least one of the blade members into the frame member in response to an applied force between the frame member and the apparatus in a direction parallel to the first side edge; and wherein the combination of the clamp member and the fastener means is adapted for preventing movement of the frame member in a second direction relative to the support member, the second direction being opposite the first direction.

19. A method for anchoring a mobile building structure having a body member rigidly supported on a frame member, the frame member having a flange member extending therefrom and spaced from the body member, the flange member having a first side edge, the method comprising the steps of:

(a) providing a support member having a supporting surface;

(b) anchoring the support member with the supporting surface in contact with the flange member;

(c) providing a clamp member having a blade member; and (d) tightly fastening the clamp member to the support member with the flange member between the blade member and the supporting surface, whereby the blade member penetrates into the flange member along a line intersecting the first side edge for preventing relative movement between the frame member and the support member.

20. An anchor apparatus for a mobile building structure having a body member rigidly supported on a frame member, the frame member having a flange member extending therefrom and spaced from the body member, the flange member having a first side edge, the apparatus comprising:

(a) a support member having a supporting surface for contacting the frame member;

(b) means for fixedly securing the support member to a grounded footing;

(c) a clamp member having a pair of spaced apart blade members; and (d) fastener means for connecting the clamp member to the support member, the blade members being adapted for locally deforming the flange member in response to tightening of the fastener means for preventing relative movement between the frame member and the support member in a direction parallel to the first side edge, each blade member forming an apex included angle in a plane perpendicular to the supporting surface, each of the apex included angles having a bisector, the bisectors being inclined in a plane perpendicular to the supporting surface and parallel to the first side edge, the bisectors intersecting above the supporting surface for facilitating the prevention of relative movement between the frame member and the support member.

21. An anchor apparatus for a mobile building structure having a body member rigidly supported on a frame member, the frame member having a flange member extending therefrom and spaced from the body member, the flange member having a first side edge, the apparatus comprising:

(a) a support member having a supporting surface for contacting the frame member;

(b) means for fixedly securing the support member to a grounded footing;

(c) a clamp member having at least one blade member;

(d) fastener means for connecting the clamp member to the support member, comprising a pair of fastener members, the fastener members protruding the support member and the clamp member, the blade member being adapted for locally deforming the flange member in response to tightening of the fastener means for preventing relative movement between the frame member and the support member in a direction parallel to the first side edge;

(e) means for securing the clamp member comprising means for selectively locating the clamp member in a plurality of discrete positions relative to the support member, the means for locating comprising a pair of spaced apart first engagement means on one of the clamp member and the support member and a plurality of pairs of second engagement means on the other of the clamp member and the support member, the fastener members engaging the first engagement means and selectively engaging one pair of the second engaging means.

* * * * *